US008042371B2

(12) United States Patent
Saupe et al.

(10) Patent No.: US 8,042,371 B2
(45) Date of Patent: Oct. 25, 2011

(54) DEVICE FOR ROTATIONALLY LOCKING THE SUPPORTING ROLL BALANCED ARCHITECTURE OF ROLL STANDS

(75) Inventors: Michael Saupe, Siegen (DE); Bernd Zieser, Netphen (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 436 days.

(21) Appl. No.: 12/309,389

(22) PCT Filed: Jul. 11, 2007

(86) PCT No.: PCT/EP2007/006165
§ 371 (c)(1),
(2), (4) Date: Mar. 24, 2009

(87) PCT Pub. No.: WO2008/006571
PCT Pub. Date: Jan. 17, 2008

(65) Prior Publication Data

US 2009/0199611 A1 Aug. 13, 2009

(30) Foreign Application Priority Data

Jul. 14, 2006 (DE) ..... 10 2006 032 813

(51) Int. Cl.
*B21B 31/00* (2006.01)

(52) U.S. Cl. ..... 72/237; 72/235; 72/236; 72/239; 72/464

(58) Field of Classification Search ..... 72/237, 72/238, 239, 243, 245, 464
See application file for complete search history.

(56) References Cited

U.S. PATENT DOCUMENTS

| | | | | |
|---|---|---|---|---|
| 3,702,557 | A * | 11/1972 | Amend | 72/238 |
| 3,805,572 | A * | 4/1974 | Busch | 72/238 |
| 4,453,393 | A * | 6/1984 | Hino et al. | 72/241.8 |
| 4,706,484 | A * | 11/1987 | Dittmar et al. | 72/225 |

FOREIGN PATENT DOCUMENTS

| | | |
|---|---|---|
| DE | 44 17 274 | 11/1995 |
| DE | 296 03 117 | 4/1996 |
| DE | 101 16 988 | 10/2002 |
| EP | 0 791 410 | 8/1997 |
| GB | 1 036 821 | 7/1966 |

* cited by examiner

*Primary Examiner* — Dana Ross
*Assistant Examiner* — Homer Boyer
(74) *Attorney, Agent, or Firm* — Lucas & Mercanti, LLP; Klaus P. Stoffel

(57) ABSTRACT

In a rolling stand (1), especially a plate rolling stand, with a right housing column (2), a left housing column (3), an upper column crosshead (4) that connects them, at least one pair of work rolls and one pair of backup rolls and associated chocks, a balancing device with brackets (5, 6) and a piston rod (7) that extends upward through the column crosshead (4) beyond the upper surface (8) of the column crosshead (4), the piston rod (7) has a yoke (10) at its outer end (9), which yoke (10) is oriented in the rolling direction and engages the brackets (5, 6) of the balancing device, and a rotating sleeve (11), which encloses the piston rod (7), is arranged between the upper edge (12) of the balancing cylinder (22) and the lower edge (13) of the yoke (10), is supported on the column crosshead (4), and has at least one open slot (14) into which the yoke (10) can drop.

7 Claims, 5 Drawing Sheets

DEVICE FOR ROTATIONALLY LOCKING THE SUPPORTING ROLL BALANCED ARCHITECTURE OF ROLL STANDS

The invention concerns a rolling stand, especially a plate rolling stand, with a right housing column, a left housing column, an upper column crosshead that connects them, at least one pair of work rolls and one pair of backup rolls and associated chocks, a balancing device with brackets, and a piston rod that extends upward through the column crosshead beyond the upper edge of the column crosshead.

An example of a previously known rolling stand of this type is shown in FIG. 1. The piston rod moves up or down during the balancing of the backup rolls and is thus an indicating device that shows the position of the backup roll balancing system.

DE 101 16 988 A1 discloses a rolling stand with means for lifting and/or lowering the intermediate roll and/or work roll rails during a roll change. In this regard, the backup roll balancing crossheads, which pull the upper set of backup rolls towards the auxiliary adjustment device by means of the backup roll balancing cylinders, are coupled with the respective upper roll rails by connecting rods in such a way that during the lifting/lowering of the backup roll balancing crossheads, the roll rails are raised/lowered.

DE 296 03 117 U1 discloses a cluster mill, especially a six-high rolling mill, with an upper and a lower backup roll, an upper and a lower work roll, and possibly an upper and a lower intermediate roll, a device for balancing the backup rolls, roll bending devices for the work rolls and the intermediate rolls, a device for mutual axial shifting of the work rolls and/or intermediate rolls, and devices for horizontal parallel shifting of the work rolls or intermediate rolls. The cluster mill is characterized by two functional units integrated in the windows of the two columns of the rolling stand. Each functional unit has two pairs of hydraulic actuating cylinders, which are arranged symmetrically and parallel to the plane of the roll axes. Each pair of actuating cylinders consists of an upper actuating cylinder with an upper actuating piston that acts on the chock of the upper backup roll for balancing the upper backup roll and a lower actuating cylinder with a lower actuating piston that acts on the chock of the lower backup roll for balancing the lower backup roll, and the two actuating cylinders of each pair of actuating cylinders are mounted coaxially in a common cylinder housing. The cylinder housing is divided into two cylinder chambers by a base and has hydraulically displaceable, double-acting adjustment sleeves on the actuating cylinders of the pairs of actuating cylinders. The adjustment sleeves produce bending of the intermediate rolls and the work rolls and have projections or the like which act on the chocks of the intermediate rolls and the work rolls.

When the work rolls and/or backup rolls are being changed, the respective chocks are moved away from each other, for example, by means of bolts, in order to prevent contact between the respective roll surfaces. That is, the rolling stand is moved up. In this connection, the distances to be considered are different, so that the corresponding chocks and the backup roll balancing system occupy different positions in the housing window and in the rolling stand. To maintain this position, the devices in the rolling stand are locked.

For one thing, the locking systems of backup roll balancing systems are necessary to allow mechanical locking of the upper backup roll and backup roll balancing arms during inspection work in the rolling stand. This provides safety for maintenance personnel working at the rolling stand with the work rolls moved out of the rolling stand. For another thing, in case of a drop in hydraulic pressure during the work roll and/or backup roll change and an associated drop in the balancing system, the locking system serves the purpose of maintaining a well-defined position for moving the rolls back in.

In plate rolling stands, the backup roll balancing system is mechanically locked in a roll change position. This it brought about by means of four hydraulic cylinders that push lock bolts beneath the projections provided on the upper brackets, which can rest on the lock bolts. Visual inspection of the satisfactory function of these lock bolts is not possible, since they are concealed by the brackets and are not accessible. The loading capacity is limited by the mounting of brackets on the upper column crosshead, in which brackets the lock bolts are displaced.

In the case of stands with a high roll gap height, the change levels during work roll change and during backup roll change are different due to deflection bending and due to the resulting larger backup roll chocks. In the case of stands of this design, heretofore, only one of the two change levels was mechanically secured. This means a considerable safety gap in the other two cases, if the directions given in the maintenance manuals are not followed.

Therefore, the objective of the invention is to specify a backup roll locking mechanism, which is independent of the roll gap height and mechanically locks the backup roll balancing system in both changing positions. The locking mechanism should be readily accessible at all times, it should be possible to monitor it visually, and it should be easy to maintain.

In accordance with the invention, this objective is achieved by virtue of the fact that, in a device according to the introductory clause of Claim 1, the piston rod has a yoke at its outer end, which yoke is oriented in the rolling direction and engages the brackets of the balancing device, and a rotating sleeve, which encloses the piston rod, is arranged between the upper edge of the column crosshead and the lower edge of the yoke, is supported on the column crosshead, and has at least one slot into which the yoke can drop.

Further refinements of the device are specified in the dependent claims.

Rolling Operation

If the locking cylinder is in the starting position, the yoke that carries the brackets drops into the lowest slot of the rotating sleeve. As customary, the balancing device can enter all possible positions without any mechanical contact. Even the position in which the backup roll cylinder moves up to the block can be adjusted without any problems.

Locking the Backup Roll Balancing System During a Work Roll Change

At the beginning of the work roll change, the rolling stand is moved up, i.e., the upper rolls are raised, and as a result, the backup roll balancing system is raised. The locking cylinder turns the rotating sleeve in stage 1. The mechanical adjustment mechanism then moves to the work roll changing level. The backup roll balancing system follows and lets the yoke down on the rotating sleeve. This position is thus secured.

Locking the Backup Roll Balancing System During a Backup Roll Change

At the beginning of the backup roll change, the rolling stand is moved up, i.e., the upper rolls are raised, and as a result, the backup roll balancing system is raised. The locking cylinder turns the rotating sleeve in stage 2. The mechanical adjustment mechanism then moves to the backup roll changing level. The backup roll balancing system follows and lets the yoke down on the rotating sleeve. This position is thus secured.

The locking system of the invention is suitable both for new stands and for the retrofitting of old installations. The individual design possibilities for the rotating sleeve make it possible to use this system for all stands, regardless of the roll gap height.

The advantages of the locking system of the invention are:

High level of safety for operating personnel due to the securing of the rolling stand area during the roll changes.

High operating reliability due to positive-locking force transmission.

Low maintenance expense, since there is only one locking cylinder.

Good maintenance conditions due to good accessibility.

Safely locked state, can be immediately recognized visually.

Electric monitoring of the given position.

Can be used universally for roughing stands and finishing stands.

Retrofitting of existing installations is possible.

A specific embodiment of the invention is described in greater detail below with reference to highly schematic drawings.

Figure 1:
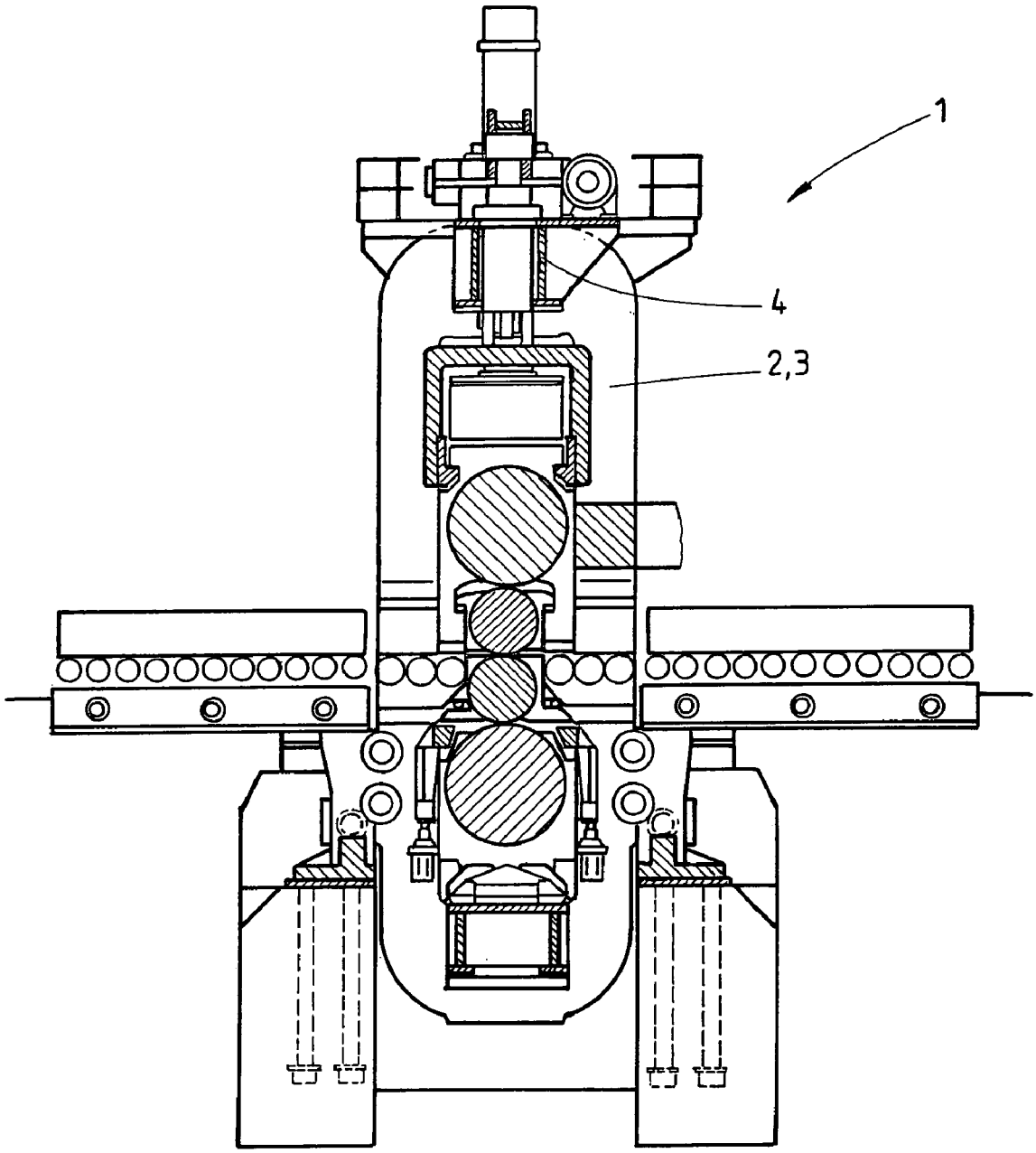
FIG.1 Prior Art
FIG. 1 shows a prior-art rolling stand in a partially cutaway side view.

FIG. 1 shows a partially cutaway side view of a prior-art rolling stand 1 with housing columns 2, 3 and a column crosshead 4 that joins them. The column crosshead 4 contains a backup roll balancing system, whose piston rod projects upward out of the column crosshead 4.

Figure 2:
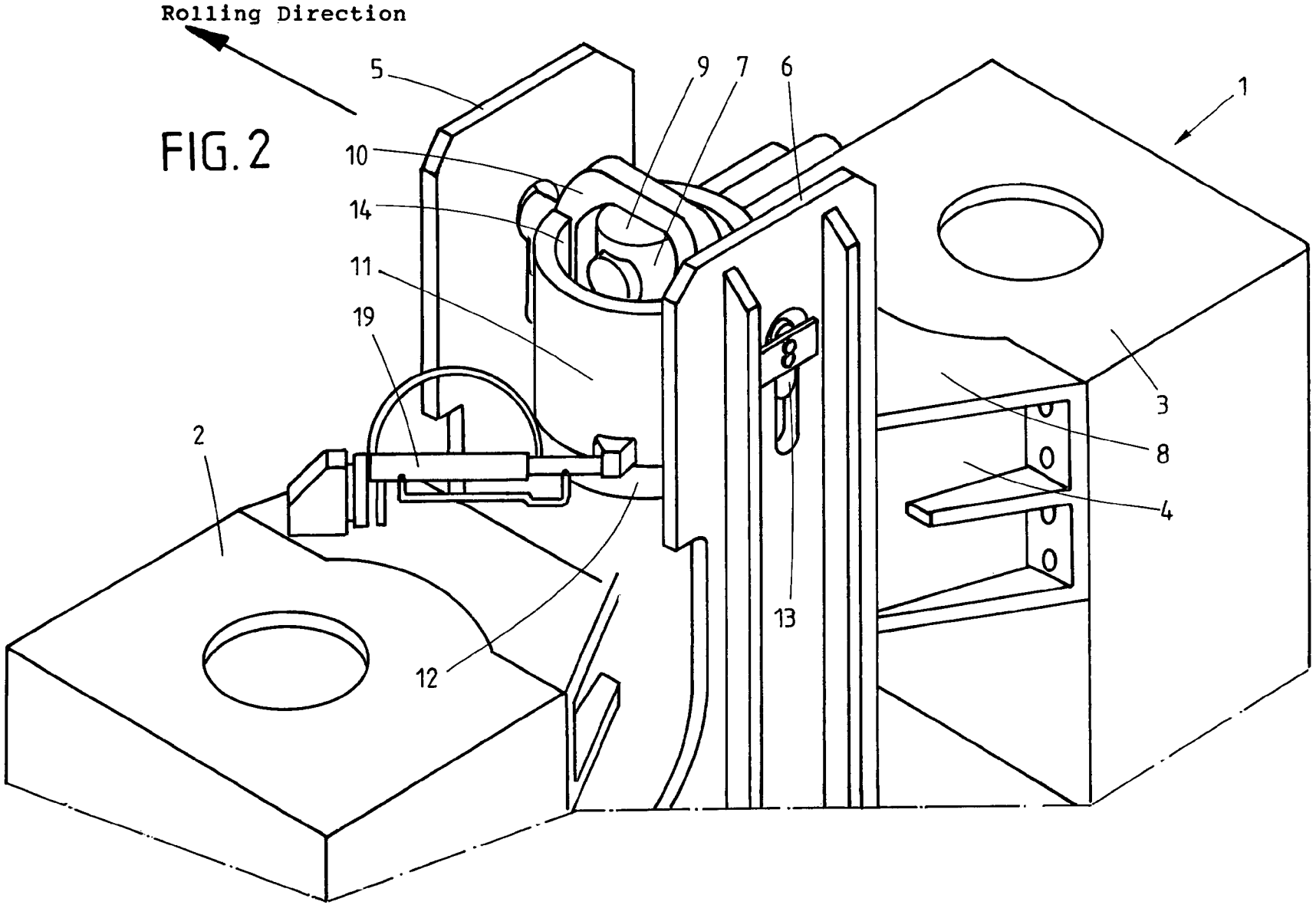
FIG. 2 shows a perspective drawing of a rolling stand of the invention.

FIG. 2 shows a perspective view of a rolling stand of the invention 1 with a left mill housing column 2 and a right mill housing column 3. The columns 2, 3 are joined at their upper ends by a column crosshead 4. A piston rod 7 extends upward out of the column crosshead 4, is slotted at its outer end 9, and holds a yoke 10. This yoke 10, which is mounted on the piston rod 7, for example, with a bolt, is oriented in the direction of rolling, and its ends engage the brackets 5, 6 of a balancing device. A rotating sleeve 11, which is arranged around the piston rod 7, is supported on the upper surface 12 of a balancing cylinder 22 (see FIG. 5) of the balancing device. The yoke 10 is located with its lower edge 13 above the rotating sleeve 11. During the rolling operation, as shown in FIG. 2, the yoke 10 moves in a slot 14 of the rotating sleeve 11. The slot 14 is described in greater detail in connection with FIG. 3. The rotating sleeve 11 is coupled with a hydraulic cylinder 19, which maintains the indicated position during the rolling operation.

During a work roll change, the stand is moved up, and the yoke 10 and the brackets 5, 6 supported on it are moved vertically upward. To lock this position, the rotating sleeve 11 is turned about its vertical axis by the hydraulic cylinder 19 until it reaches a position in which the lower edge 13 of the yoke 10 rests on the bearing surface 18 (see FIG. 3).

During the work roll change, the yoke is not set down on the rotating sleeve (surface 18), but rather is held at a distance of about 10 mm above it. The position is entered by the mechanical adjusting device, and the backup roll balancing device balances the backup roll with respect to the adjustment device. The rotating sleeve merely ensures that, in the event of a failure of the hydraulic system, the backup rolls and the support arms do not crash down in the rolling stand (danger to maintenance personnel when the work rolls have been dismounted). However, it can also come to rest on the bearing surface 18, e.g., during maintenance/repair work. The rotating sleeve thus not only serves the purpose of safe support of the yoke (backup roll change), but also secures, with a certain amount of distance, the position that has been entered during the work roll change. The yoke 10 cannot move farther downward; the opening position for changing the work rolls is secured.

When the backup rolls are changed in another step, the rolling stand is moved up farther, and the rotating sleeve 11 is turned farther by means of the hydraulic cylinder until the lower edge 13 of the yoke 10 rests on the upper annular surface 21 of the rotating sleeve 11, and this position is secured. After the work rolls and/or backup rolls have been changed, the rotating sleeve 11 is turned back to its initial position, in which the yoke 10 can drop into the slot 14.

Figure 3:
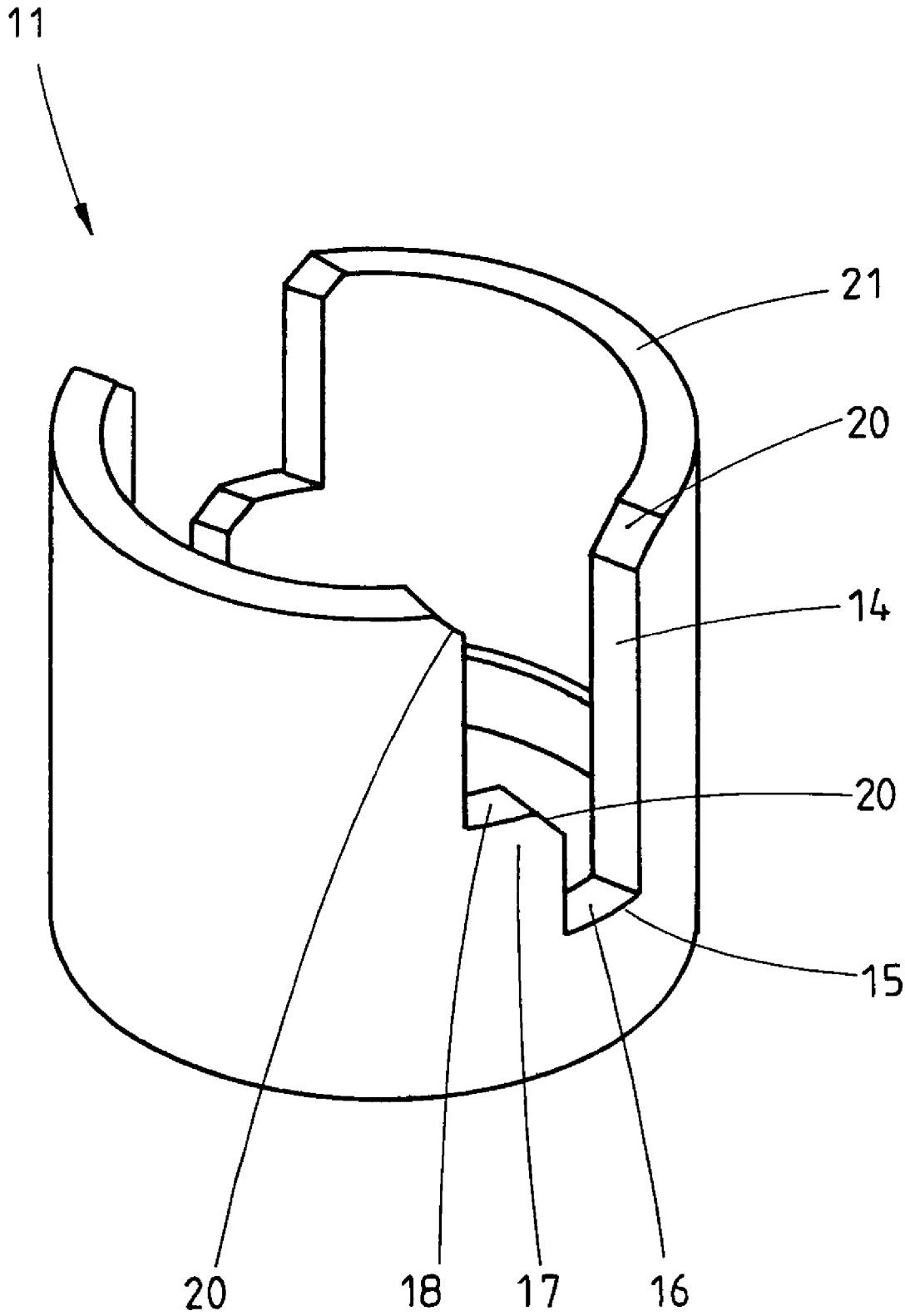
FIG. 3 shows a perspective view of a rotating sleeve as an individual part.

FIG. 3 shows detail of the rotating sleeve 11 in a perspective view. The rotating sleeve 11 has an axial slot 14, into which the yoke 10 (not shown) can drop. For the rolling operation of the rolling stand 1, the yoke 10 moves vertically until it reaches the bearing surface 16. During a work roll change, the rotating sleeve is turned, and the yoke 10 is set down on the bearing surface 18. During the backup roll change, the rotating sleeve 11 is turned again, and the yoke 10 is set down on the upper annular surface 21 of the rotating sleeve 11.

FIG. 4 shows top views of the various rotational positions of the rotating sleeve 11.

Figures 4A, 4B, 4C:
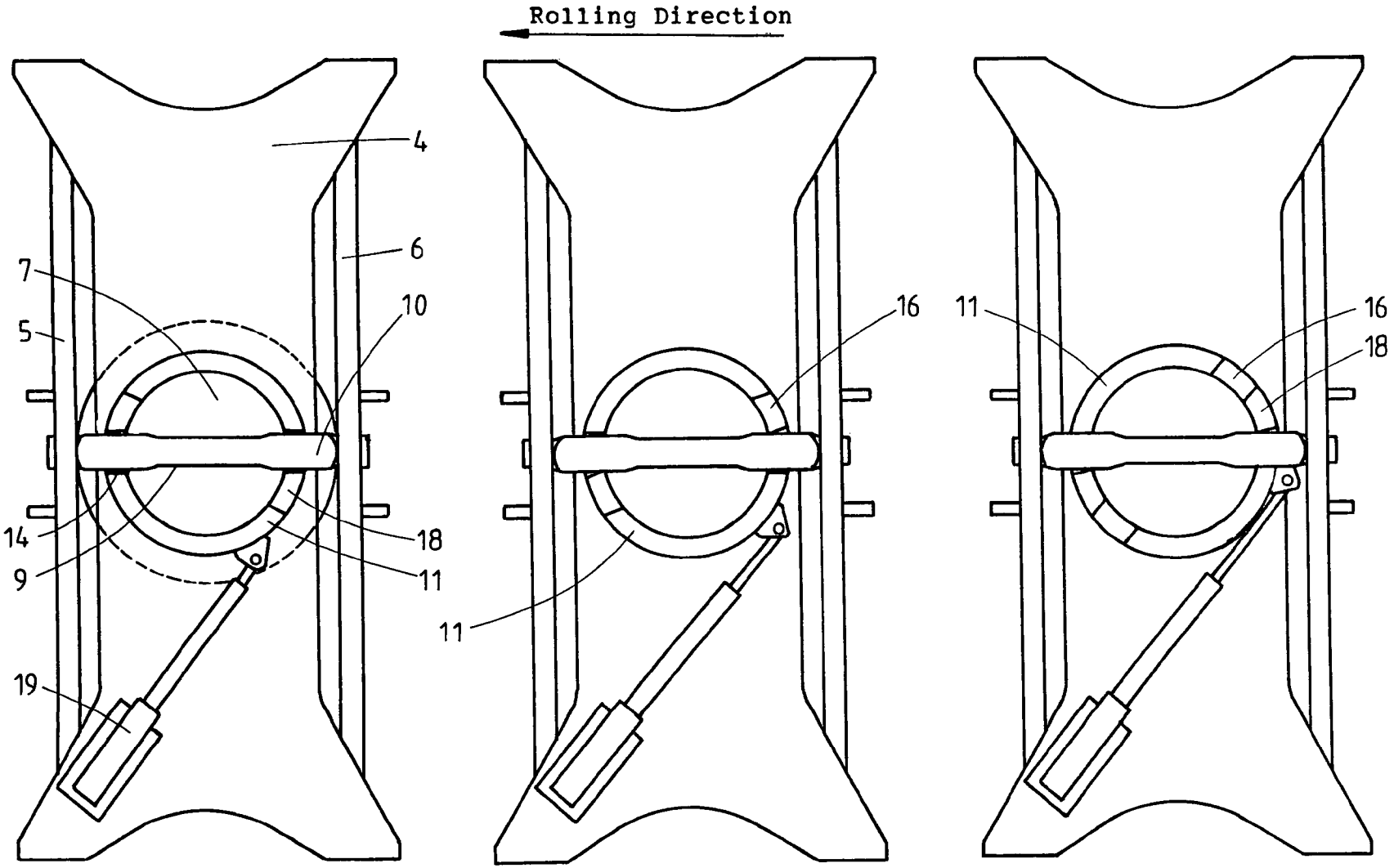
FIG. 4 shows top views of the positions of the rotating sleeve during rolling operation, during a work roll change, and during a backup roll change.

FIG. 4*a* shows the position during rolling operation. The rotating sleeve 11 is oriented in such a way in the direction of rolling that the yoke 10 can drop into the slot 14. That is, the yoke 10 moves freely in the slot 14. In this view, the bearing surface 18 (see FIG. 3) can be seen.

If the work rolls are being changed, as shown in FIG. 4*b*, the rotating sleeve 11 is turned by means of the hydraulic cylinder 19. To produce a locked state, the yoke 10, which was previously moved all the way up, is lowered onto the bearing surface 18 (see FIG. 3). Now the bearing surface 16 (see FIG. 3) can be seen from above.

During a backup roll change, the rotating sleeve is turned into a third indexing position. In this operating step, which is shown in FIG. 4*c*, the lower edge 13 of the yoke 10 comes to rest on the upper annular surface 21 of the rotating sleeve 11. Both the bearing surface 16 and the bearing surface 18 can now be seen from above.

The installation of the hydraulic cylinder 19 allows the rotating sleeve 11 to be held in the given position into which it has been moved. However, it is also possible to use a different type of drive to turn the rotating sleeve 11. In addition, it is possible to provide additional bearing surfaces for setting down the lower edge 13 of the yoke 10 in order to obtain additional locking positions. In another design of the rotating sleeve 11, a slot 14 is formed without bearing surface 18.

Figure 5:
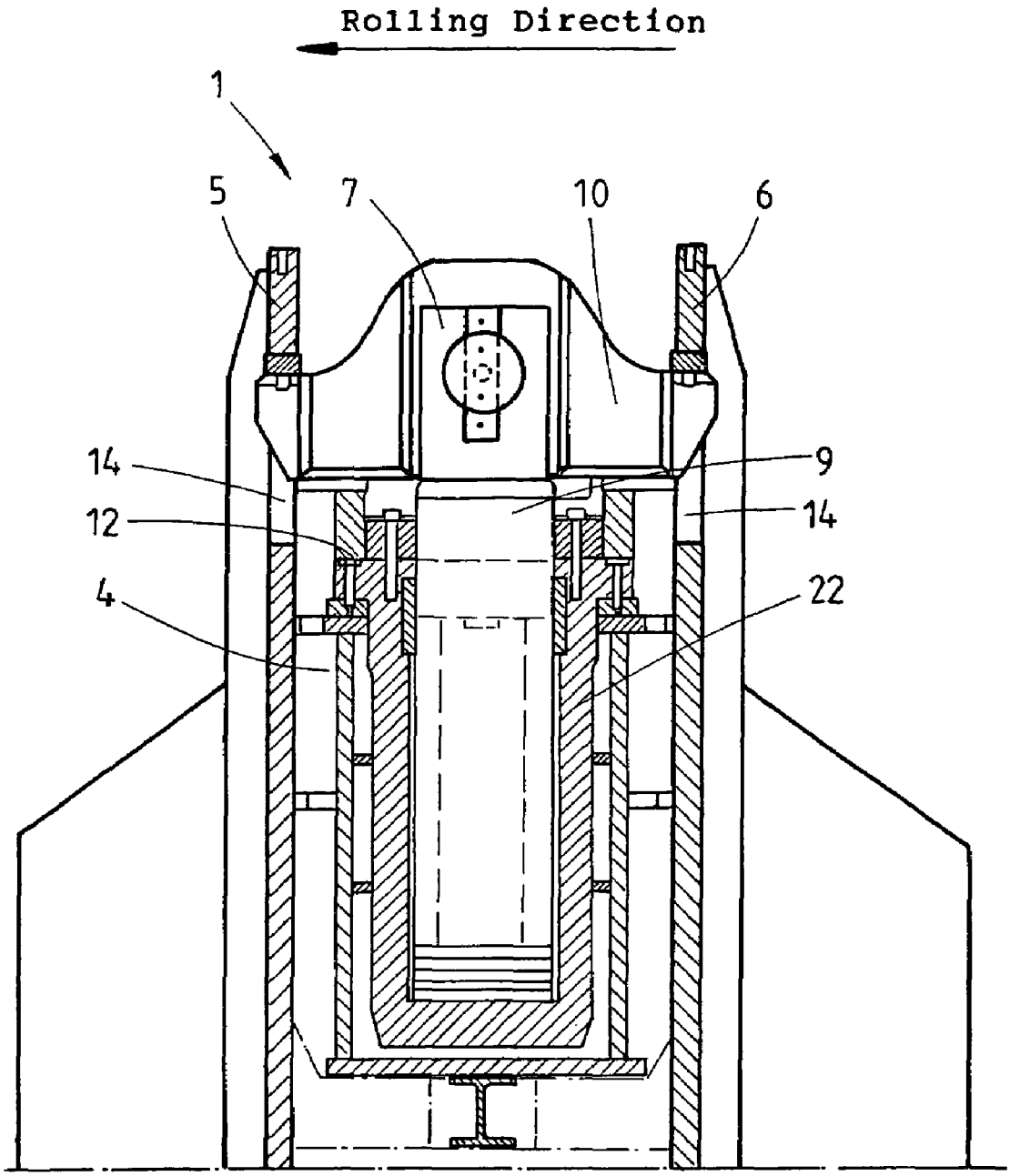
FIG. 5 shows a longitudinal section through the rolling stand using the balancing device of the invention In all of the drawings, technical features that are the same are labeled with the same reference numbers.

FIG. 5 shows a longitudinal section through the rolling stand of the invention. The drawing shows how the balancing cylinder 22 is hung in an opening of the column crosshead 4.

LIST OF REFERENCE NUMBERS

1 rolling stand
2 left housing column

3 right housing column
4 column crosshead
5 bracket
6 bracket
7 piston rod
8 upper surface
9 outer end
10 yoke
11 rotating sleeve
12 upper edge
13 lower edge
14 slot
15 recess
16 bearing surface
17 recess
18 bearing surface
19 hydraulic cylinder
20 insertion bevels
21 upper annular surface
22 balancing cylinder

The invention claimed is:

1. A rolling stand (1), especially a plate rolling stand, with a right housing column (3), a left housing column (2), an upper column crosshead (4) that connects them, at least one pair of work rolls and one pair of backup rolls and associated chocks, a balancing device, which has brackets (5, 6) and a balancing cylinder (22), which is hung with its upper edge (12) in the form of a collar in an opening in the column crosshead (4), and a piston rod (7) that extends upward through the column crosshead (4) beyond the upper surface (8) of the column crosshead (4), wherein the piston rod (7) has a yoke (10) at its outer end (9), which yoke (10) is oriented in the rolling direction and engages the brackets (5, 6) of the balancing device, and a rotating sleeve (11), which encloses the piston rod (7), is arranged between the upper edge (12) of the balancing cylinder (22) and the lower edge (13) of the yoke (10), is supported on the column crosshead (4), and has at least one open slot (14) into which the yoke (10) can drop.

2. A rolling stand in accordance with claim 1, wherein the slot (14) has a first recess (15) with a bearing surface (16).

3. A rolling stand in accordance with claim 2, wherein the slot (14) has a second recess (17) with a second bearing surface (18).

4. A rolling stand in accordance with claim 1, wherein the rotating sleeve (11) is connected with a hydraulic cylinder (19).

5. A rolling stand in accordance with claim 1, wherein the rotating sleeve (11) is connected with an electric motor.

6. A rolling stand in accordance with claim 1, wherein a thrust bearing is mounted between the rotating sleeve (11) and the upper edge (12) of the balancing cylinder.

7. A rolling stand in accordance with claim 1, wherein the slot (7) is constructed with insertion bevels.

* * * * *